US009306339B2

(12) United States Patent
Hasegawa et al.

(10) Patent No.: US 9,306,339 B2
(45) Date of Patent: Apr. 5, 2016

(54) ELECTRICAL CONNECTOR WITH TWO SIGNAL AND TWO GROUNDING CONTACT ENDS ALTERNATELY POSITIONED IN TWO ROWS

(71) Applicant: Tyco Electronics Japan G.K., Kanagawa (JP)

(72) Inventors: Izumi Hasegawa, Kanagawa (JP); Naoki Hashimoto, Kanagawa (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 14/512,826

(22) Filed: Oct. 13, 2014

(65) Prior Publication Data

US 2015/0031242 A1 Jan. 29, 2015

Related U.S. Application Data

(63) Continuation of application No. PCT/JP2013/052181, filed on Jan. 31, 2013.

(30) Foreign Application Priority Data

Apr. 13, 2012 (JP) ..... 2012-92014

(51) Int. Cl.
*H01R 13/6597* (2011.01)
*H01R 13/6471* (2011.01)
(Continued)

(52) U.S. Cl.
CPC ..... *H01R 13/6597* (2013.01); *H01R 12/71* (2013.01); *H01R 13/646* (2013.01); *H01R 13/6471* (2013.01)

(58) Field of Classification Search
CPC ..... H01R 13/646–13/648; H01R 13/6471
USPC ..... 439/607.28, 101, 108, 607.05
See application file for complete search history.

(56) References Cited

U.S. PATENT DOCUMENTS 6,890,193 B2 * 5/2005 Kimura et al. ..... 439/108
7,909,653 B1 * 3/2011 Wan et al. ..... 439/660
7,972,151 B2 * 7/2011 He et al. ..... 439/108
(Continued)

FOREIGN PATENT DOCUMENTS

JP 8315916 A 11/1996
JP 200780782 A 3/2007
(Continued)

OTHER PUBLICATIONS

PCT International Preliminary Report on Patentability, International Application No. PCT/JP2013/052181, dated Oct. 14, 2014, 5 pages.

*Primary Examiner* — Chandrika Prasad
(74) *Attorney, Agent, or Firm* — Barley Snyder

(57) ABSTRACT

An electrical connector is disclosed having a plurality of contacts. The plurality of contacts includes contact ends positioned in two rows and terminating ends positioned in one row. A first grouping of the plurality of contacts includes units of two differential signal carrying contacts having signal carrying contact ends connected to two signal terminating ends on a one to one ratio. The first grouping also includes grounding contacts positioned adjacent to the signal carrying contacts, and having grounding contact ends connected to grounding terminating ends with a ratio of the number of grounding contact ends being greater than or equal to the number of grounding terminating ends.

17 Claims, 17 Drawing Sheets

(51) Int. Cl.
*H01R 12/71* (2011.01)
*H01R 13/646* (2011.01)

(56) References Cited

U.S. PATENT DOCUMENTS 8,512,071 B2 * 8/2013 Tseng et al. ..... 439/493
8,777,663 B2 * 7/2014 Annis et al. ..... 439/607.05
2004/0235324 A1 * 11/2004 Kimura et al. ..... 439/108
2005/0159040 A1 * 7/2005 Brunker et al. ..... 439/497
2010/0173529 A1 * 7/2010 He et al. ..... 439/660

FOREIGN PATENT DOCUMENTS

JP 2010157505 A 7/2010
JP 2010238409 A 10/2010
JP 201140224 A 2/2011

* cited by examiner

ELECTRICAL CONNECTOR WITH TWO SIGNAL AND TWO GROUNDING CONTACT ENDS ALTERNATELY POSITIONED IN TWO ROWS

CROSS-REFERENCE TO RELATED APPLICATION

This application is a continuation of PCT Application No. PCT/JP2013/052181, dated Jan. 31, 2013, and claiming priority to Japanese Patent Application No. 2012-92014, dated Apr. 13, 2012.

FIELD OF THE INVENTION

The invention generally relates to an electrical connector, and more specifically to an electrical connector that transmits a differential signal.

BACKGROUND

Japanese Patent Application No. 2010-157505A discloses a conventional electrical connector that transmits a differential signal. The connector has a plurality of contacts having contact end portions positioned in two rows along a mating face, and contact terminating portions extending in one row out of a circuit board mounting side of the connector. The contact terminating portions extend in one row, because if the contacts terminating portions on circuit board mounting side were in a two row configuration similar to the contact end portions on the mating end, inspection or repair of soldering of an inner row would be obstructed by an outer row. Therefore, particularly in surface mounted connectors, the contact terminating portions are conventionally arranged in one row.

However, since all of the contact terminating portions extend in one row, the width of the electrical connector will be longer than a connector having the contact terminating portions extending in a two row configuration from the circuit board mounting side. The width presents a limitation in designing electrical connectors that are smaller in size. There is a need for a connector having a two-row contact end portion configuration on a mating face of the connector, and a row of contact terminating portions extending from the circuit board mounting with a smaller width, while not obstructing the inspection or repair of soldering.

SUMMARY

An electrical connector has a plurality of contacts. The plurality of contacts includes contact ends positioned in two rows and terminating ends positioned in one row. A first grouping of the plurality of contacts includes units of two differential signal carrying contacts having signal carrying contact ends connected to two signal terminating ends on a one to one ratio. The first grouping also includes grounding contacts positioned adjacent to the signal carrying contacts, and having grounding contact ends connected to grounding terminating ends with a ratio of the number of grounding contact ends being greater than or equal to the number of grounding terminating ends.

BRIEF DESCRIPTION OF DRAWINGS

The invention will now be described by way of example, with reference to the accompanying Figures, of which.

DETAILED DESCRIPTION OF THE EMBODIMENT(S)

Figure 1:
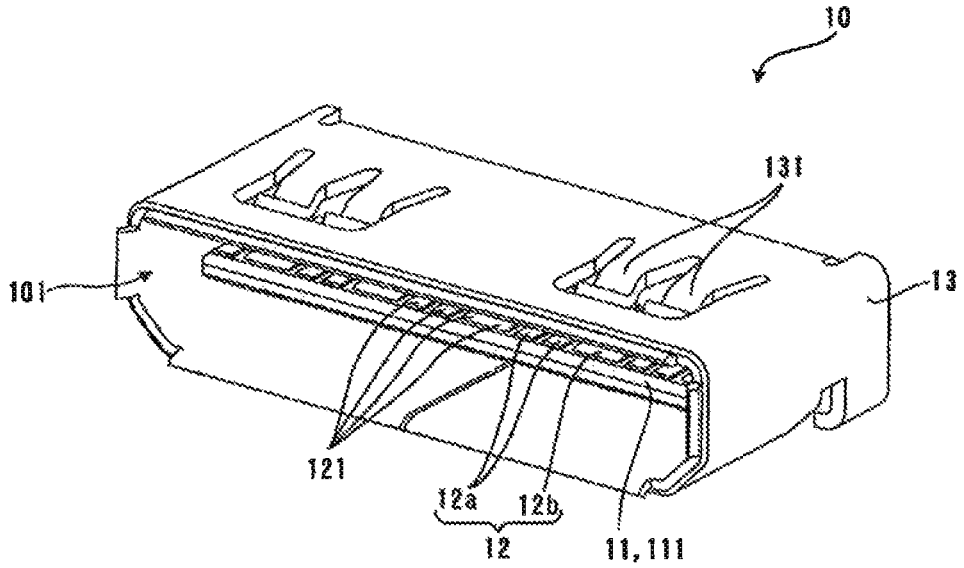
FIG. 1 is a perspective view of a mating face of an electrical connector.

An electrical connector 10 has a plurality of contacts 12 positioned in a housing 11. The housing 11 is enclosed by a shield 13 made of metal. Cantilevered arm members 131 are formed in the shield 13. The arm members 131 are brought into contact with a shield of a complimentary mating connector (not shown) mated with the electrical connector 10 to retain shielding performance, and press against the mating connector to secure the mating connector and ensure the mating connector remains connected. In an embodiment, the housing 11 is made of resin, and the shield 13 is made of metal.

In the embodiment of FIG. 1, the contact 12 includes contact ends 121. The contact ends 121 are positioned inside a mating connector receiving opening 101 of the shield 13, and on a tongue 111 of the housing 11 (also see FIG. 7). The mating connector receiving opening 101 is disposed on a mating end of the electrical connector 10. The contact ends 121 are positioned on the tongue 111. The contact ends 121 are brought into contact with a complimentary contact of the mating connector.

The contacts 12 include a signal carrying contact 12*a* having a narrower plate-like portion and a first grounding contact 12*b* having a wider plate-like portion on a mating end. The narrower signal carrying contacts 12*a* are brought into contact with one contact of the mating connector, while the wider first grounding contacts 12*b* are brought into contact with two contacts of the mating connector. For example, one contact end 121 may contact each narrower plate-like portion, while two contact ends 121 may be present for each wider plate-like portion, such that the two contact ends 121 are both positioned on the wider plate-like portion.

In the embodiment in FIG. 1, while only an upper surface of the tongue 111 is shown having the contacts 12 positioned thereon, the contacts 12 are also positioned on a lower surface of the tongue 111. In the embodiment, the contacts 12 are positioned in two rows along opposite surfaces of the tongue 111.

Figure 2:
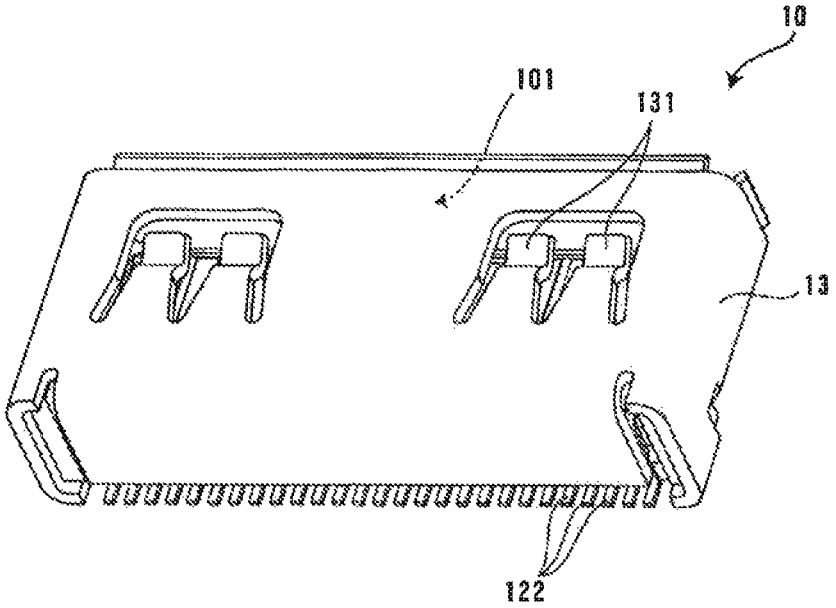
FIG. 2 is a perspective view of a rear face of the electrical connector of FIG. 1.

In the embodiment of FIG. 2, the contact 12 includes a contact terminating end 122. The contact terminating ends 122 are surface-mounted on a circuit board (not shown). As shown in FIG. 2, the contact terminating ends 122 are positioned in one row.

Figure 3:
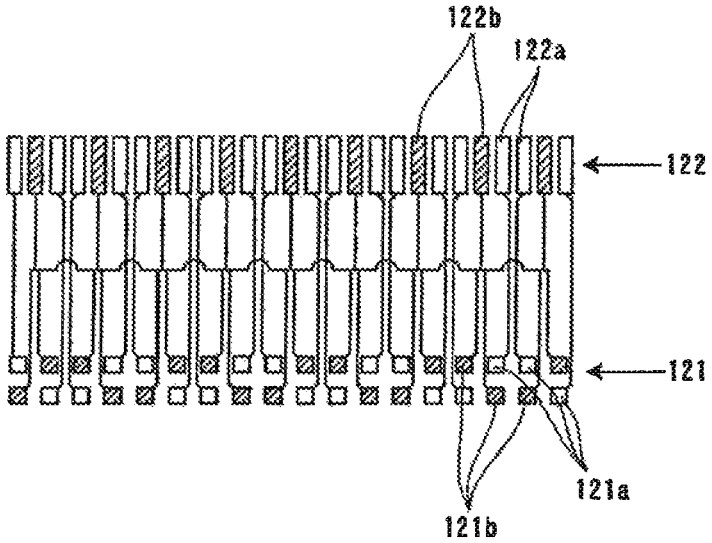
FIG. 3 is a configuration diagram of a relationship of connection between first contact members and second contact members of the electrical connector of FIG. 1.

In the embodiment of FIG. 3, the contact ends 121 are positioned in two rows along the mating end of the connector 10, and the contact terminating ends 122 are position in one row along a circuit board facing end of the connector 10.

The contact ends 121 include white-square signal contact ends 121*a* that carry signals. The signal contact ends 121*a* are positioned as pairs of adjacent signal contact ends 121*a* to carry a differential signal. However, the white signal contact ends 121*a* positioned at both right and left ends have no adjacent signal contact ends 121*a* to be paired with, and are therefore are optionally available to be used for carrying a low-speed signal other than a differential signal, or as a ground terminal, a power terminal, or other similar applications known to those of ordinary skill in the art. The differential-signal carrying signal contact ends 121*a*, excluding the white signal contact ends 121*a* positioned at both the right and left ends, are referred to as a first grouping of contact ends 121.

The hatched-square grounding contact ends 121*b* are ground-connection contact members. The grounding contact ends 121*b* are referred to as a second grouping of contact ends 121.

The grounding contact ends 121*b* are positioned adjacent to the differential-signal carrying signal contact ends 121*a*. The term "adjacent" may include neighboring in a same row and in a different row. In an embodiment, the grounding contact ends 121*b*, excluding the grounding contact ends 121*b* at both the right and left ends, are adjacent to the differential-signal carrying signal contact ends 121*a* both in the same row and in the different row. However, as discussed above, the signal contact ends 121*a* shown as white squares at both the right and left ends are not differential-signal carrying terminals, so the grounding contact ends 121*b* at both the right and left ends are adjacent only to the differential-signal carrying signal contact ends 121*a* in the same row.

In an embodiment, the contact ends 121 are positioned in two rows where two differential-signal carrying signal contact ends 121*a* and two grounding contact ends 121*b* alternate. The contact ends 121 are positioned such that the phases of the signal contact ends 121*a* and the grounding contact ends 121*b* alternate between the two rows so that the signal contact ends 121*a* and the grounding contact ends 121*b* face each other on different rows.

Since the pair of signal contact ends 121*a* carrying differential-signal are arranged so as to be surrounded by the grounding contact ends 121*b*, the shielding performance is improved so that crosstalk between adjacent differential signals is reduced.

In the embodiment of FIG. 3, of the contact terminating ends 122 include two signal terminating ends 122*a* shown as a white rectangle, similar to the signal contact ends 121*a* shown as a white square, are positioned adjacent to contact members which are paired to carry a differential signal. In this regard, however, the white-rectangular signal terminating ends 122*a* positioned at both right and left ends, like the signal contact ends 121*a*, are connected to the signal contact ends 121*a* at both the right and left ends, respectively, and are optionally used for carrying a low-speed signal other than a differential signal, or used as a ground terminal, a power terminal, or other similar applications known to those skilled in the art. Of these white-rectangular signal terminating ends 122*a*, the differential-signal carrying signal terminating ends 122*a*, excluding the two contact members positioned at both the right and left ends, are referred to as a first grouping of signal terminating ends 122*a*.

In an embodiment, hatched-rectangular grounded terminating ends 122*b* are connected to the grounding contact ends 121*b*, and used for ground connection. These grounded terminating ends 122*b* are referred to as a second grouping of grounded terminating ends 122*b*.

In the above described embodiment, paired signal terminating ends 122*a* and paired grounded terminating ends 122*b* are alternately arranged.

In another embodiment, in comparison of the number of contact ends 121 with the number of contact terminating ends 122, the white-square signal contact ends 121*a* and the white-rectangular signal terminating ends 122*a* are the same in number. However, the number of hatched-square grounding contact ends 121*b* is eighteen in FIG. 3, while the number of hatched-rectangular grounded terminating ends 122*b* is nine. That is, the number of grounded terminating ends 122*b* is reduced to half the number of grounding contact ends 12 lb.

This allows the contact terminating ends 122 to be arranged with predetermined pitches, and further achieves a reduction in overall dimensions of the electrical connector.

In the above embodiments, signal contact ends 121*a* shown as a white square and the signal terminating ends 122*a* shown as a white rectangle are the same in number, and are connected to each other on a one-to-one ratio. That is, the signal contact ends 121*a* and the signal terminating ends 122*a* are connected to each other one by one.

However, all of the grounding contact ends 121*b* and grounded terminating ends 122*b* in the above embodiments are connected to each other.

Figure 4:
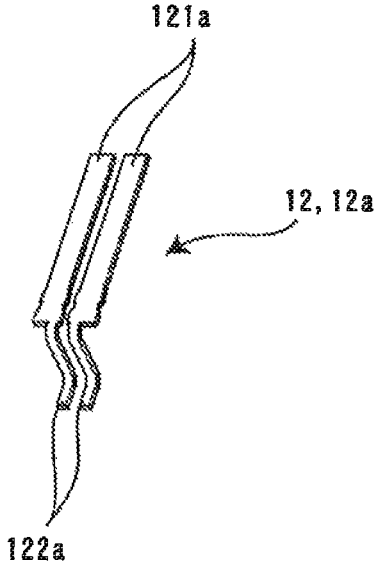
FIG. 4 is a perspective view showing differential-signal carrying contacts of the electrical connector in FIG. 1.

In an embodiment of FIG. 4, the signal carrying contacts 12*a* are differential-signal carrying contacts. Although FIG. 4 shows two signal carrying contacts 12*a*, only one signal carrying contact 12*a* is disposed at each of the right and left ends, and used for a purpose other than for carrying a differential signal, as described above with reference to FIG. 3.

Further, as described with reference to FIG. 3, the differential-signal carrying signal contact ends 121*a* and signal terminating ends 122*a* are connected to each other on a one-to-one basis via the signal carrying contacts 12*a*. The signal contact ends 121*a* may include a plurality of contact members, but the signal contact ends 121*a* are connected to the signal terminating ends 122*a* on a one-to-one basis.

Figure 6:
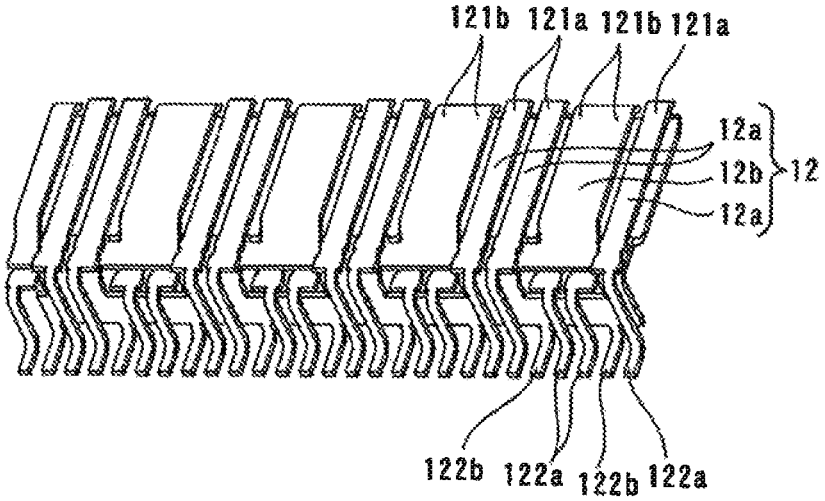
FIG. 6 is a perspective view of a combination of the differential-signal carrying contacts in FIG. 4 and the ground-connection contact in FIG. 5.

Additionally, the signal carrying contacts 12*a* are positioned along an upper and a lower row, namely, in a row proximate to the circuit board and in a row distal to the circuit board (see FIG. 6). Therefore, the signal carrying contacts 12*a* include a signal carrying contact 12*a* having a longer leg and a signal carrying contact 12*a* having a shorter leg on the contact terminating end 122. In the embodiment of FIG. 4, the signal carrying contacts 12*a* having the shorter legs are positionable in the row proximate to the circuit board. The signal carrying contacts 12*a* positioned in the row distal to the circuit board has structure same as the signal carrying contacts 12*a* shown in FIG. 4, except the length of the leg is longer.

Figure 5:
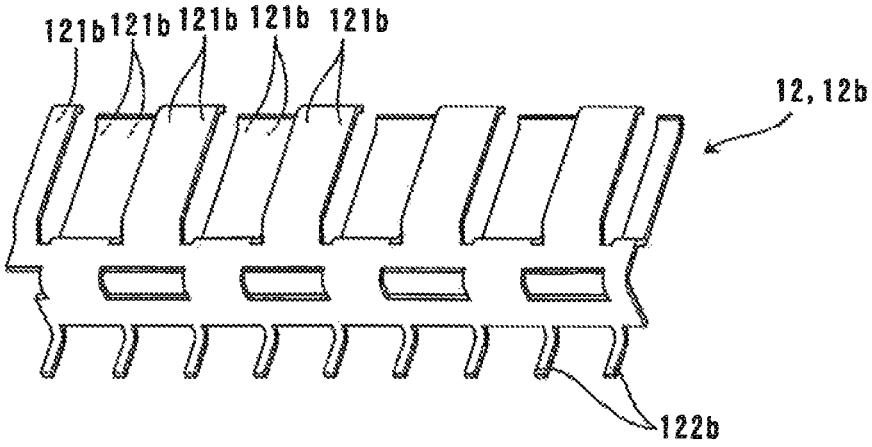
FIG. 5 is a perspective view of a ground-connection contact of the electrical connector in FIG. 1.

In the embodiment of FIG. 5, the first grounding contact 12*b* is a ground-connection contact. The grounding contact ends 121*b* are positioned along upper and lower two rows on the mating end, shown in FIG. 1, of the first grounding contact 12*b*. As described in the embodiments above, two grounding contact ends 121*b* are positioned on each wider-plate-like portion, such that two ground-connection contacts of the mating connector come into contact with one plate-like portion. One grounding contact end 121*b* is positioned on each of the narrower plate-like members formed at both ends. The tongue 111 of the housing 11 is inserted into between these two rows of plate-like members so that these plate-like members are supported by the tongue 111 of the housing 11. (See FIGS. 1 and 7) In an embodiment shown in FIGS. 1 and 7, nine grounded terminating ends 122*b* are formed at equal intervals.

Figure 7:
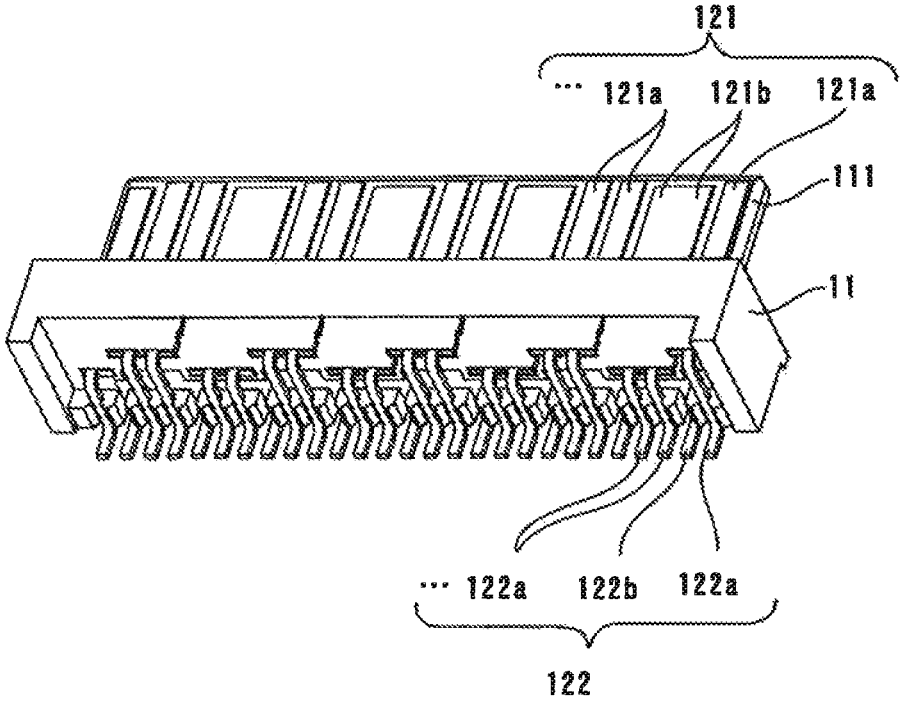
FIG. 7 is a perspective view of a contact housing having the contacts in FIG. 6.

The contacts 12 in the embodiments of FIGS. 6 and 7 are supported by the housing 11, which is positioned in the electrical connector 10 embodiment shown in FIGS. 1 and 2. Therefore, the connections between the contact ends 121 and the contact terminating ends 122, and the connections between the contact ends 121 and the contact terminating ends 122, as shown in the FIG. 3, are maintained.

The electrical connector 10, described above in the embodiments of FIGS. 1 and 2, and having the plate-like contacts 12 described in the embodiments of FIGS. 4-6, is a male contact.

In the embodiments of the electrical connector 10 of FIGS. 8-18, the electrical connector 10 has substantially the same structure as the embodiments discussed above of FIGS. 1-7. As such, only differences from the embodiments described above will be described below.

In the embodiment of FIG. 3, all the grounding contact ends 121*b* and all the grounded terminating ends 122*b* are connected to each other.

Figure 8:
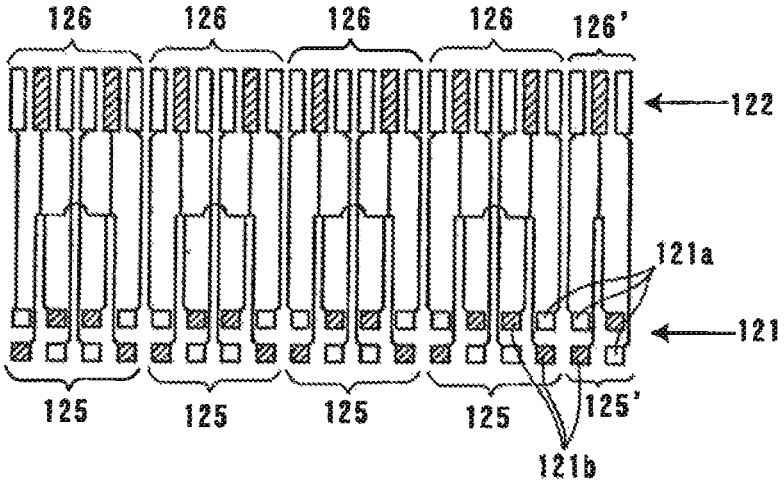
FIG. 8 is a configuration diagram of a relationship of connection between first contact members and second contact members in an electrical connector.

In an embodiment of FIG. 8, the grounding contact ends 121*b* and grounded terminating ends 122*b* are divided into a plurality of groups. The contact ends 121 are divided into groups 125, each group 125 including a total of eight contacts ends 121 positioned in two rows. Each row includes four consecutive contact ends 121. However, a contact end group 125' at an end of the two rows cannot complete eight contact ends 121 and therefore has only four contact ends 121.

The contact terminating ends 122 are divided into groups 126, each group 126 including six consecutive contact terminating ends 122 positioned in two rows. A terminating end group 126', positioned at the same end as the contact end group 125', cannot complete six second contact members, and therefore has only three contact terminating ends 122.

Taken together, the group 125 of eight contact members for the contact ends 121 and the group 126 of six contact members for the contact terminating ends 122 have four grounding contact ends 121*b* within one group 125 and the two grounded terminating ends 122*b* within one group 126 connected to each other. However, the contact end group 125' and terminating end group 126' have two grounding contact ends 121*b* within the contact end group 125' that are connected to one grounded terminating end 122*b* within the terminating end group 126'.

Figure 9:
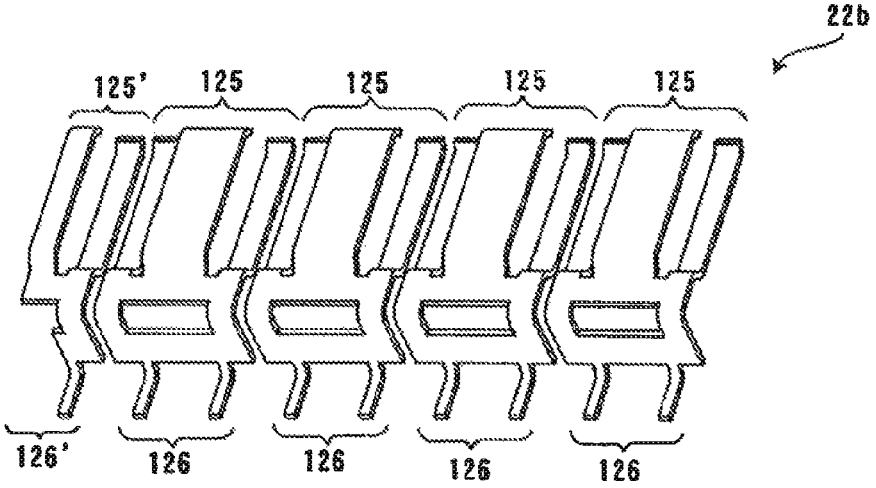
FIG. 9 is a perspective view of ground-connection contacts of the electrical connector in FIG. 8.

In the embodiment of FIG. 9, a second grounding contact 22*b* replaces the first grounding contact 12*b* shown in FIG. 5.

The second grounding contact 22*b*, described with reference to FIG. 8, has a shape divided into separated groups.

While the second grounding contact 22*b* shown in FIG. 9 is referred to as a ground-connection contact, in one embodiment the plurality of second grounding contact 22*b* function as a ground-connection. However, in the embodiment of FIG. 9, the second grounding contact 22*b* is not limited to serving as a ground-connection, but each may alternatively function as a power supply. Therefore, one skilled in the art would appreciate that for the embodiment of FIG. 9, the second grounding contact 22*b* may be used in a variety of applications than that of the first grounding contact 12*b* described in the above embodiments.

Figure 10:
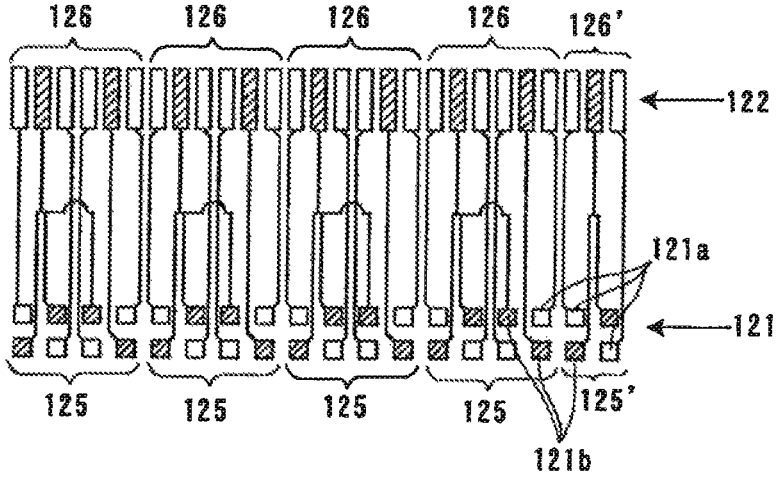
FIG. 10 is a diagram illustrating a relationship of connection between first contact members and second contact members in an electrical connector.

In an embodiment of FIG. 10, contact members are also divided into groups 125, 125'; 126, 126', similar to the embodiment of FIG. 8. However, where the embodiment of FIG. 8 has all the grounding contact ends 121*b* and grounded terminating ends 122*b* connected to each other within the same groups 125, 126, in the embodiment of FIG. 10, connections are split evenly within one of the groups 125, 126, such that some of the four grounding contact ends 121*b* within one group 125 (three grounding contact ends 121*b* shown in FIG. 10) are connected to one of the two grounded terminating ends 122*b* within one group 126. In addition, the remainder of the four grounding contact ends 121*b* (the remaining one grounding contact end 121*b* shown in FIG. 10) is connected to the remaining one grounded terminating end 122*b* of the two grounded terminating ends 122*b*. The contact end group 125' and terminating end group 126' at have an incomplete number of contact members, in the same manner as the embodiment of FIG. 8, and the two grounding contact ends 121*b* within the contact end group 125' are connected to one grounded terminating end 122*b*.

Figure 11:
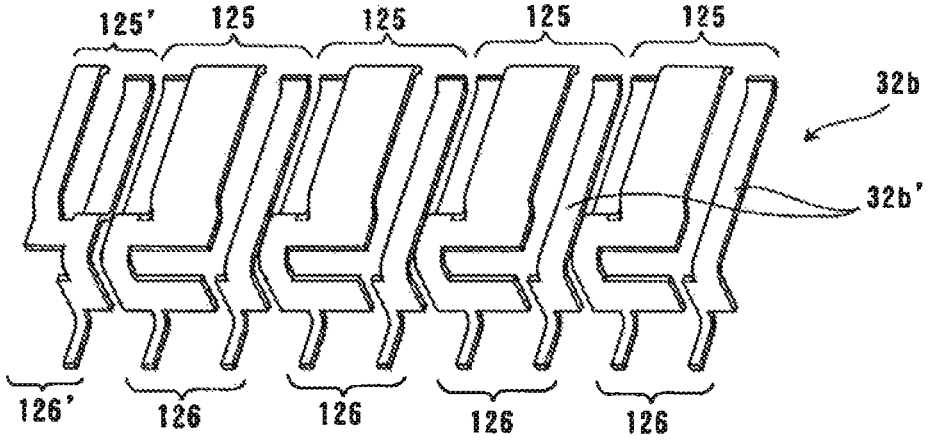
FIG. 11 is a perspective view of ground-connection contacts of the electrical connector in FIG. 8.

In the embodiment of FIG. 11, a third grounding contact 32*b* replaces the first grounding contact 12*b* shown in FIG. 5.

The third grounding contact 32*b* shown in FIG. 11 has a structure divided into groups and further divided into two subgroups within one group, as described above with reference to FIG. 10.

The third grounding contact 32*b* is a ground-connection contact in the context of the above description, and all of the third grounding contacts 32*b* may be used for ground connections. However, the third grounding contact 32*b'* connecting one grounding contact end 121*b* and one grounded terminating end 122*b* on a one-to-one basis in other embodiments may carry a low-speed signal.

In the exemplary embodiments of FIGS. 4-6 and 9-11, contacts are described having a plate-like portion against which a contact of a mating connector is pressed, resulting in an electrical connector 10 having male contacts.

However, FIGS. 12-18 disclose exemplary embodiments of an electrical connector 10 having female contacts. The embodiments of FIGS. 12-18 described below have contacts differing in shape from the contact in the various embodiments described above, but the relationship of electrical connection remains substantially the same as described above.

The signal carrying contacts 12*a* shown in FIG. 4 are male contacts, and when female contacts of a mating connector (not shown) are brought into contact with the plate-like portion of the signal carrying contact 12*a*, the female contacts are elastically deformed to engage the male contacts. In an embodiment of FIG. 12, signal carrying contacts 42*a* are female contacts. The signal carrying contacts 42*a* engage with plate-like contacts of a mating contact (not shown). The signal carrying contacts 42*a* include signal contact ends 121*a* that are elastically deformed by the plate-like contacts of the mating connector, and the signal carrying contacts 42*a* hold the plate-like contact under elastic contact. Similar to the signal carrying contacts 12*a* shown in FIG. 4, the signal contact end 121*a* of the signal carrying contacts 42*a* may include a plurality of contacts, but the signal contact end 121*a* is connected to the signal terminating end 122*a* on a one-to-one ratio.

Figure 12:
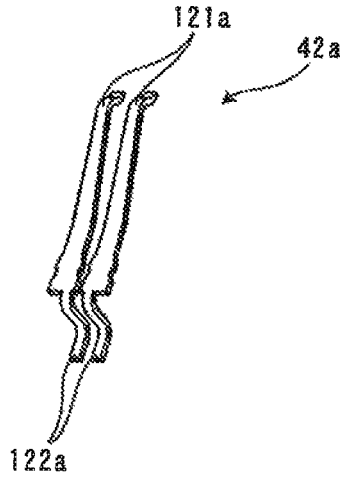
FIG. 12 is a perspective view of differential-signal carrying contacts of an electrical connector.
Figure 14:
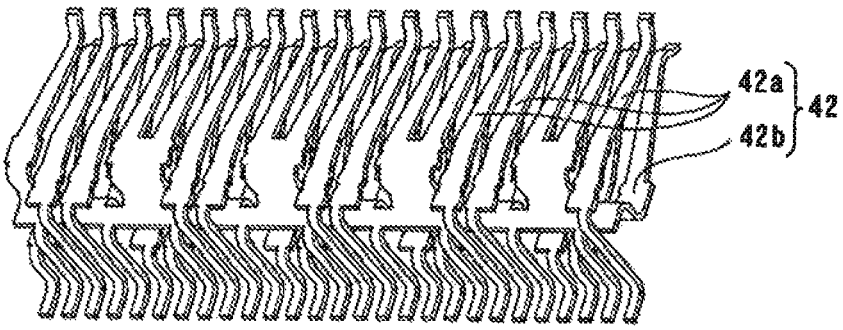
FIG. 14 is a perspective view of a combination of the differential-signal carrying contacts in FIG. 12 and the ground-connection contact in FIG. 13.

Similar to the embodiment of FIG. 5, the signal carrying contacts 42*a* include signal carrying contacts 42*a* having longer legs and signal carrying contacts 42*a* having shorter legs on the signal terminating end 122*a* side (see FIG. 14). The signal carrying contacts 42*a* shown in the embodiment of FIG. 12 are contacts each having a shorter leg of these two kinds of contacts.

Figure 13:
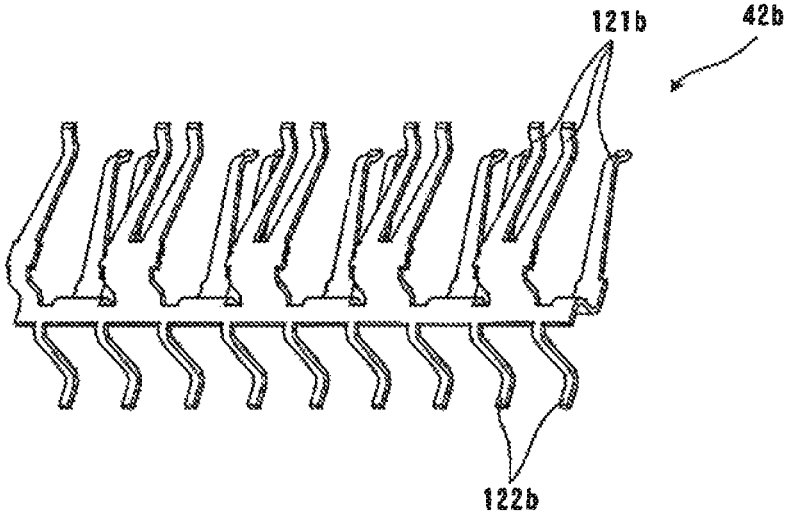
FIG. 13 is a perspective view of a ground-connection contact of the electrical connector in FIG. 12.

In the embodiment of FIG. 13, a fourth grounding contact 42*b* also has the same relationship of connection between contact members as the first grounding contact 12*b* shown in FIG. 5, except that the fourth grounding contact 42*b* is a female contact. For example, the fourth grounding contact 42*b*, as described above with reference to FIG. 3, includes the grounding contact end 121*b* connected with all the grounded terminating ends 122*b* to establish a ground connection.

Figure 15:
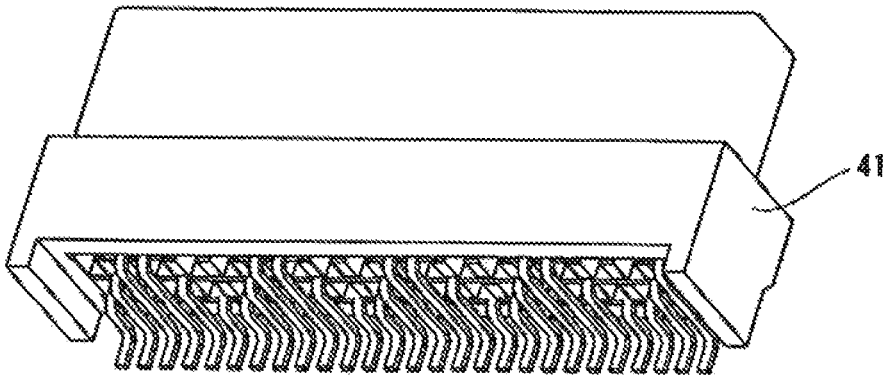
FIG. 15 is a rear perspective view of a contact housing having the contacts in FIG. 14.

In an embodiment of FIG. 14, the signal carrying contacts 42*a* are positioned in combination with the fourth grounding contacts 42*b*, and an embodiment of FIG. 15 shows the contacts 42*a*, 42*b* positioned on a housing 41. In FIG. 15, the respective arrangements of the contact ends 121 and the contact terminating ends 122 of the contacts 42*a*,42*b*, is the same as the connection between the contact ends 121 and the contact terminating ends 122 shown in FIG. 3.

Figure 16:
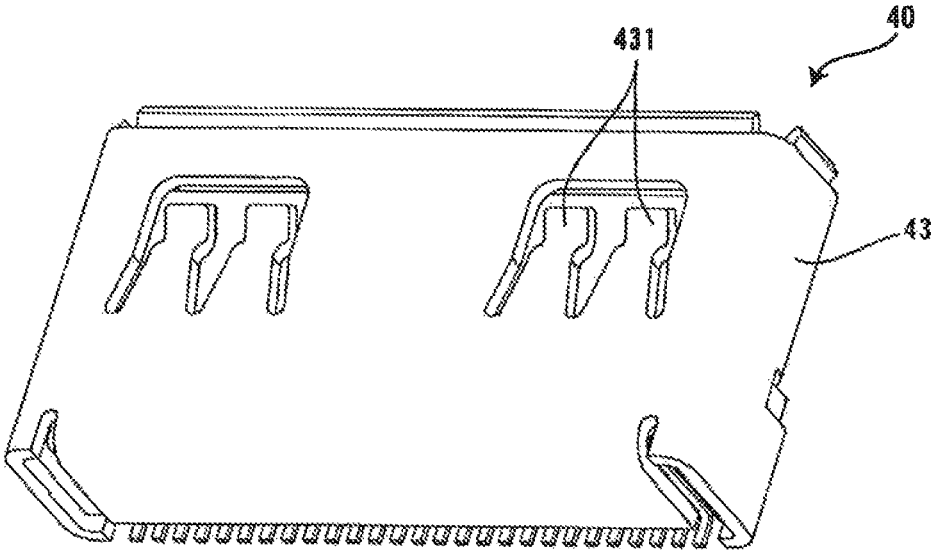
FIG. 16 is a rear perspective view of the electrical connector in FIG. 12.

In the embodiment of FIG. 16, an electrical connector 40 includes the housing 41 covered with a shield 43 made of metal. Cantilevered arm members 431 are formed in the shield 43, and press against a shield of a mating connector (not shown), like the electrical connector 10 shown in FIGS. 1 and 2.

Figure 17:
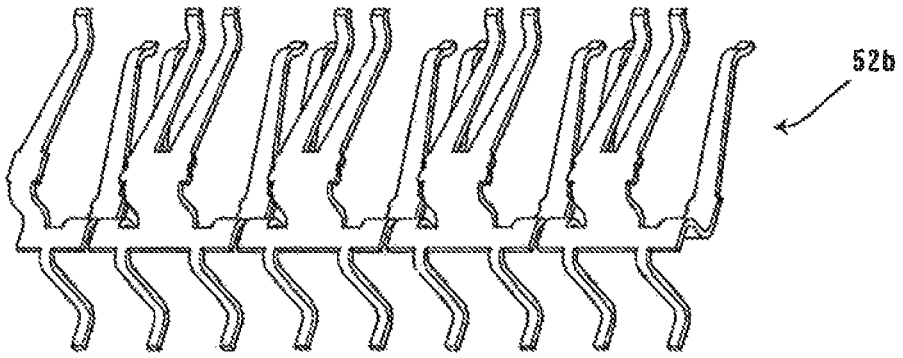
FIG. 17 is a perspective view of ground-connection contacts of an electrical connector.

In the embodiment of FIG. 17, fifth grounding contacts 52*b* replace the fourth grounding contact 42*b* shown in FIG. 13. The fifth grounding contacts 52*b* are divided into groups, as described above with reference to FIG. 8.

The fifth grounding contact 52*b* has the same connection relationship between contact members as the grounding contact 22*b* in the embodiment described above for FIG. 9, except that the fifth grounding contact 52*b* is a female contact, and is therefore not described further.

Figure 18:
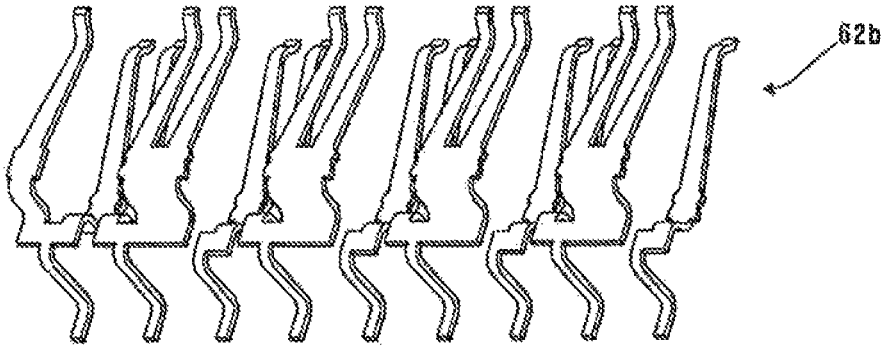
FIG. 18 is a perspective view of ground-connection contacts of an electrical connector.

In the embodiment of FIG. 18, sixth grounding contacts 62*b* replace the fourth grounding contacts 42*b* shown in FIG. 13. The sixth grounding contacts 62*b* are divided into groups and further divided into two subgroups per one group, as described above with reference to FIG. 9.

The sixth grounding contact 62*b* has the same relationship of connection between contact members as the third grounding contact 32*b* described above in the embodiment of FIG. 11, except that the sixth grounding contact 62*b* is a female contact, and is therefore not described further.

What is claimed is:

1. An electrical connector comprising:

a plurality of contacts having contact ends positioned in two rows, and terminating ends positioned in one row; and a first grouping of the plurality of contacts which includes units of two differential signal carrying contacts having signal carrying contact ends connected to two signal terminating ends on a one to one ratio, and grounding contacts positioned adjacent to the signal carrying contacts and having grounding contact ends connected to grounding terminating ends with a number of grounding contact ends being greater than a number of grounding terminating ends;

wherein two of the signal carrying contact ends and two of the grounding contact ends are alternately positioned in the two rows such that the signal carrying contact ends are surrounded by the grounding contact ends.

2. The electrical connector according to claim 1, wherein the units of signal carrying contact ends and the grounding contact ends are positioned such that the phases of the signal contact ends and the grounding contact ends alternate between the two rows so that the signal contact ends and the grounding contact ends in opposing rows face each other.

3. The electrical connector according to claim 1, wherein two grounding contact ends are positioned adjacent to the two signal carrying contact ends.

4. The electrical connector according to claim 1, further comprising a second grouping of the plurality of contacts having the same composition as the first grouping.

5. The electrical connector according to claim 4, wherein the two grounding contact ends of the first grouping are positioned adjacent to two grounding contact ends of the second grouping.

6. The electrical connector according to claim 5, wherein the two grounding contact ends of the first grouping and the two grounding contact ends of the second grouping are alternately positioned.

7. The electrical connector according to claim , wherein all of the grounding contact ends and all of the grounding terminating ends are connected to each other.

8. The electrical connector according to claim 1, wherein the contact ends are divided into a plurality of contact end groups.

9. The electrical connector according to claim 8, wherein each contact end group has eight contact ends positioned in two rows.

10. The electrical connector according to claim 9, wherein each row includes four consecutive contact ends.

11. The electrical connector according to claim 9, wherein each contact end group is connected to six contact terminating ends.

12. The electrical connector according to claim 11, wherein each contact end group includes four grounding contact ends connected to two grounded terminating ends, and four signal contact ends connected with four signal terminating ends.

13. The electrical connector according to claim 12, wherein each contact end group includes four signal contact ends connected with four signal terminating ends.

14. The electrical connector of claim 11, wherein each contact end group includes three grounding contact ends connected to a first grounded terminating end, and one grounding contact end connected to second grounding terminating end.

15. The electrical connector according to claim 14, wherein each contact end group includes four signal contact ends connected with four signal terminating ends.

16. The electrical connector according to claim 1, wherein the contact ends are male-type contact ends.

17. The electrical connector according to claim 1, wherein the contact ends are female-type contact ends.

* * * * *